US010087040B2

(12) United States Patent
Morey

(10) Patent No.: US 10,087,040 B2
(45) Date of Patent: Oct. 2, 2018

(54) RETRACTABLE CORD STORAGE REEL ASSEMBLY

(71) Applicant: THE MOREY CORPORATION, Woodridge, IL (US)

(72) Inventor: Dana Morey, Glen Ellyn, IL (US)

(73) Assignee: THE MOREY CORPORATION, Woodridge, IL (US)

( * ) Notice: Subject to any disclaimer, the term of this patent is extended or adjusted under 35 U.S.C. 154(b) by 74 days.

(21) Appl. No.: 15/458,675

(22) Filed: Mar. 14, 2017

(65) Prior Publication Data

US 2018/0093852 A1 Apr. 5, 2018

Related U.S. Application Data

(60) Provisional application No. 62/402,097, filed on Sep. 30, 2016.

(51) Int. Cl.
*H02G 11/00* (2006.01)
*B65H 75/44* (2006.01)

(52) U.S. Cl.
CPC ..... *B65H 75/4452* (2013.01); *B65H 75/4434* (2013.01); *B65H 2701/34* (2013.01); *B65H 2701/3919* (2013.01)

(58) Field of Classification Search
CPC ..... B65H 75/4434; B65H 75/4452; B65H 2701/34; B65H 2701/3919; H02G 11/00
See application file for complete search history.

(56) References Cited

U.S. PATENT DOCUMENTS

| | | | | |
|---|---|---|---|---|
| 1,446,410 A | | 2/1923 | Bennett et al. | |
| 1,904,000 A | | 5/1929 | Hoyt | |
| 2,438,515 A | | 3/1948 | Mohler | |
| 2,518,071 A | | 8/1950 | Rushworth | |
| 3,061,234 A | | 10/1962 | Morey | |
| 3,409,246 A | | 11/1968 | De Pas | |
| 3,657,491 A | * | 4/1972 | Ryder | B65H 75/4434 191/12.2 R |
| 3,695,544 A | | 10/1972 | Morey, Sr. | |
| 4,053,118 A | | 10/1977 | Aikins | |
| 4,209,215 A | | 6/1980 | Verma | |

(Continued)

FOREIGN PATENT DOCUMENTS

CA 2014710 4/1990

*Primary Examiner* — Sang K Kim
(74) *Attorney, Agent, or Firm* — Olson & Cepuritis, Ltd.

(57) ABSTRACT

A retractable cord reel assembly comprises a reel rotatably supported within a frame or housing for rotation about an axis; a biasing spring engaged with the reel; and a single unitary electrically conductive cord having a distal end portion affixed to the housing, and a movable proximal end, wherein the cord is wound about the reel in a plurality of contiguous segments. The cord reel comprises separate coaxial cord-take-up and cord-storage compartments, having, in an initial cord configuration, a fixed-length segment of cord wound in a spiral around a hub in the cord-take-up compartment, and a segment comprising helical windings of the cord in the cord-storage compartment. The cord reel assembly described herein can be used in modern electronic data and power transmission applications without the significant losses of signal integrity or power, commonly associated with conventional cord reel assemblies.

15 Claims, 9 Drawing Sheets

(56) References Cited

U.S. PATENT DOCUMENTS

| | | | | |
|---|---|---|---|---|
| 4,417,703 | A | 11/1983 | Weinhold | |
| 5,094,396 | A | 3/1992 | Burke | |
| 5,655,726 | A | 8/1997 | Peterson et al. | |
| 6,019,304 | A | 2/2000 | Skowronski et al. | |
| 6,293,485 | B1 * | 9/2001 | Hollowed | B65H 75/4434 191/12.2 R |
| 6,305,632 | B1 * | 10/2001 | Hwang | B65H 75/486 242/372 |
| 6,372,988 | B1 | 4/2002 | Burke et al. | |
| 6,386,906 | B1 | 5/2002 | Burke | |
| 6,416,005 | B1 * | 7/2002 | Liao | B65H 75/4449 242/378 |
| 6,439,490 | B1 * | 8/2002 | Hwang | B65H 75/4434 191/12.4 |
| 6,495,756 | B1 | 12/2002 | Burke et al. | |
| 6,578,683 | B1 | 6/2003 | Burke et al. | |
| 6,761,579 | B2 | 7/2004 | Fort et al. | |
| 6,799,994 | B2 | 10/2004 | Burke | |
| 6,896,543 | B2 | 5/2005 | Fort et al. | |
| 7,108,216 | B2 | 9/2006 | Burke et al. | |
| 7,242,299 | B2 | 7/2007 | Kelsch et al. | |
| 7,687,721 | B2 | 3/2010 | Leitz | |
| 7,692,099 | B2 | 4/2010 | Burke | |
| 8,075,335 | B2 | 12/2011 | Burke et al. | |
| 8,123,010 | B2 | 2/2012 | Skowronski et al. | |
| 8,123,836 | B2 | 2/2012 | Kalous et al. | |
| 8,345,398 | B2 | 1/2013 | Mazzarisi et al. | |
| 8,387,763 | B2 | 3/2013 | Burke et al. | |
| 8,435,069 | B2 | 5/2013 | Burke et al. | |
| 8,657,087 | B2 | 2/2014 | Burke et al. | |
| 2003/0192760 | A1 | 10/2003 | Burke et al. | |
| 2006/0286861 | A1 | 12/2006 | Avevor et al. | |
| 2007/0194196 | A1 | 8/2007 | Okonsky et al. | |
| 2010/0215327 | A1 | 8/2010 | Braden et al. | |
| 2011/0079676 | A1 | 4/2011 | Skowronski et al. | |
| 2012/0081816 | A1 | 4/2012 | Mazzarisi | |
| 2012/0126047 | A1 | 5/2012 | Skowronski et al. | |
| 2012/0149236 | A1 | 6/2012 | Burke et al. | |
| 2012/0168272 | A1 | 7/2012 | Skowronski et al. | |
| 2012/0285723 | A1 | 11/2012 | Gundel et al. | |
| 2014/0326818 | A1 | 11/2014 | Deng | |

* cited by examiner

RETRACTABLE CORD STORAGE REEL ASSEMBLY

CROSS-REFERENCE TO RELATED APPLICATIONS

This application claims the benefit of U.S. Provisional Patent Application No. 62/402,097, filed on Sep. 30, 2016, which is incorporated herein by reference in its entirety.

FIELD OF THE INVENTION

This invention relates to a reel assembly for gathering in and paying out cords and cables, most advantageously electric power cords, data cables, or other conductor cords of portable electrical and electronic devices, tools, and other electrical or electronic devices where it is desired to move the devices around during use.

BACKGROUND

Retractable cord reels have been widely used in many applications, especially in telephonic applications. In some cord reels, the reel is spring biased so that the cord is under a constant tension when a length of cord is pulled from the reel, and automatically rewinds back onto the reel when tension is released. In other designs, the reel includes a catch or latching mechanism so that certain lengths of cord can be unwound from the reel and can be utilized without the withdrawn cord being under constant tension. Such reels also include a mechanism for automatically rewinding the cord back onto the reel when the device is no longer in use.

Many cord reels utilize a coil of flat flexible cable (FFC) as part of the data transmission circuit in the device (see e.g., U.S. Pat. No. 6,293,485 to Hollowed for one such reel design). Some forms of conventional FFC generally comprises a number of fine wires embedded within a polymeric matrix. Typically, the wires are laminated between one or more layers of a dielectric polymer sheet material, such as a polyester. Typically all of the wires are of the same size across the entire cable width. In other forms of FFC the wires are actually printed metallic traces (i.e., the FFC is a flexible printed circuit board).

Currently, FFC can be manufactured with a cable width and thickness suitable to meet USB 1.1 standards for data transmission but still fit within a relatively compact cord reel apparatus that can be conveniently mounted in, e.g., an airline seat back for use in conjunction with a telephone or game controller by passengers in flight. There is an increasing demand for corded devices that utilize a cord reel that meets USB 2.0, USB 3.0 or other standards for data and power transmission (i.e., battery charging). Cord reel designs that utilize a segment of FFC along with a conventional round-profile cord require splices from the FFC to round cord segments, which can lead to undesirable signal and power losses.

U.S. Pat. No. 3,695,544 to William J. Morey, Sr. describes a cord reel assembly that utilizes a single unitary round-profile cord, in which a majority of the cord is wound about a main cord storage compartment and a portion of the cord is wound in an adjacent disk-shaped take-up compartment having a thickness of approximately the diameter of the cord, so that the cord in the take-up compartment is constrained from flexing upward as the section of cord winds and unwinds. While this design does not include splices in the cord as in FFC-type reels, the configuration of the take-up compartment requires that the diameter of the cord reel assembly must be relatively large compared to the length of cord that can be withdrawn from the reel. The cord reel was designed for use with electrical appliances, machine tools and the like, and does not address the needs of modern electronic devices. Modern applications for cord reels often require a relatively small reel diameter relative to the desired necessary cord length that can be withdrawn from the reel, rendering the early unitary-cord reel design unsuitable for modern electronic data transfer applications.

There is an ongoing need for improved cord reel designs. The present application addresses this need.

SUMMARY OF THE INVENTION

A retractable cord reel assembly, as described herein, comprises a reel rotatably supported within a housing or frame for rotation about an axis, a biasing spring engaged with the reel, and a single unitary electrically-conductive cord (e.g., a serial data transfer cable) having a distal end portion affixed to the housing or frame and a movable proximal end. The cord is wound about the reel in a plurality of contiguous segments. The cord reel of the cord reel assembly comprises separate coaxial cord-take-up and cord-storage compartments, having, in an initial cord configuration, a fixed-length segment of cord wound in a spiral around a hub in the cord-take-up compartment, and a plurality of helical windings of the cord in the cord-storage compartment. The take-up compartment is designed to allow the spiral of cord therein to flex and become non-planar as cord is withdrawn from and retracted back into the storage compartment. The flexing of the cord in the take-up chamber surprisingly allows for a much smaller cord reel relative to the length of withdrawable cord than prior art unitary-cord reel designs. The cord reel assembly described herein is specifically designed for use in in modern electronic data and power transmission applications without the significant losses of signal integrity or power, commonly associated with conventional cord reel assemblies.

As described herein, a retractable cord reel assembly for an electronic or electric device or for connection of different electronic and electrical devices, utilizes a single, unitary electrically conductive cord or cable wound in distinct segments about a two compartment reel. The cord reel assembly has significant advantages over prior known cord reels that utilize multiple connected portions of cords or cables within the reel, because the unitary cord ameliorates the signal and power losses that are inherent in reels comprising multiple distinct electrically connected cords. Additionally, the unique cord take-up compartment design described below allows cord reels of much smaller size for a given desired cord diameter to be constructed compared to the single cord depth take-up compartment of the prior art unitary cord reel described above. The reel is rotatably supported on a frame (e.g., a housing) and is spring-biased into a given reference position. The reel includes a peripheral annular cord storage compartment surrounding a central cord storage hub, and having a depth (i.e., an extent in the axial direction) and a radial extent each equal to a plurality of cord thicknesses.

The reel also includes an annular cord take-up compartment surrounding a cord take-up hub positioned coaxial with and adjacent the cord storage compartment. The cord storage hub and the cord take-up hub are adapted and configured to rotate together about the same axis. The take-up compartment has a maximum depth in a region adjacent the cord take-up hub greater than one cord diameter, and preferably sufficient to allow a portion of the cord in the cord take-up compartment to flex in the direction of the rotational axis of the reel (e.g., about 1.5 to 3 cord diameters or greater), and preferably has a radial extent from the take-up hub to the periphery of the take-up compartment that is greater than the radial extent of the cord storage compartment from the cord storage hub to the periphery of the storage compartment. The cord storage compartment preferably has a depth in the axial direction that is greater than the maximum depth of the take-up compartment and is sufficient to accommodate multiple overlapping helical windings of the cord. The cord take-up compartment can have a uniform depth or can have a greater depth in the region of the take-up hub relative to the region of the periphery of the cord take-up compartment. In some embodiments, the cord storage compartment has a depth that is greater near or at the cord-storage hub than at the periphery thereof, e.g., having a peripheral depth that is less than the depth at the hub, and which is slightly larger than one cord diameter so as to accommodate a portion of a cord without significant binding or flexing in the axial direction as the reel is operated. The depth of the cord take-up compartment can vary smoothly from hub to periphery, in a step fashion from hub to periphery, or in some combination of smooth and step variance.

Different segments of a single, unitary cord are wound around the respective hubs of the cord storage and cord take-up compartments with a transitional segment passing through the take-up and storage hubs. The cord preferably meets modern electronic serial data transfer and charging protocols such as, e.g., USB 2.0, USB 3.0, FireWire, Thunderbolt, and the like. A distal end portion of the cord is affixed to a feature at the periphery of the cord take-up compartment, such as a frame or housing, that is rotationally stationary relative to the reel. The distal end of the cord extends out from the frame or housing and is adapted for electrical connection to an electric or electronic device or apparatus, e.g., connection to a power source and/or data processing unit for the electric or electronic device. A fixed-length segment of cord between the distal end portion and the hub of the take-up compartment is wound around the cord take-up hub in a plurality of spiral turns, while a moveable segment of cord is wound around the storage hub in a plurality of helical windings. The transitional segment of the cord between the fixed-length segment and the movable segment passes through the cord take-up and cord storage hubs. The portion of the cord that passes through the hubs remains substantially affixed within a channel or passageway that extends through the hubs (e.g., by friction and/or the windings of the moveable segment). The moveable segment of the cord is wound around the cord storage hub in the same winding direction as the spiral of the fixed-length of the cord that is wound around the cord take-up hub when the reel assembly is in its initial cord storage configuration.

A biasing spring (e.g., a spiral spring) is operably connected to the reel to automatically retract the cord back onto the reel after cord has been withdrawn therefrom. Preferably, a locking mechanism (e.g., a ratchet mechanism) is engageable with the reel to arrest the retraction of the cord after a predetermined length of cord is withdrawn. Disengaging the locking mechanism then allows the cord to be retracted.

The fixed-length segment of cord wound within the take-up compartment is approximately half the length of the maximum length of cord that is intended to be withdrawn from the reel during use of the cord reel assembly. The portion of cord wound within the cord storage compartment when the reel is in an initial rotational state is longer than the maximum length of cord that can be withdrawn from the reel during use. The fixed-length segment of cord in the cord take-up compartment is wound in a relatively tight one-dimensional spiral around the take-up hub in the initial cord storage configuration of the reel assembly, while the portion of cord in the cord storage hub typically is wound in overlapping layers of helical windings.

In use, the frame or housing of the reel assembly is generally affixed to a surface, or otherwise maintained in a stationary state, and a pulling force greater than the biasing force of the spring is applied to the proximal end of the cord, causing the reel to rotate relative to the frame, and causing a portion of the cord in the cord storage compartment to unwind and withdraw from the reel. Simultaneously, the rotation of the reel causes the spiral windings in the take-up compartment to loosen and expand radially toward the periphery of the take-up compartment. The depth of the take-up chamber allows at least the windings nearest the take-up hub to flex slightly in the direction along the rotational axis, which ameliorates binding of the fixed-length of cord as the spiral windings loosen and allows a longer spiral segment to be wound around the take-up hub for a given cord diameter and reel diameter. Once a length of cord approximately equal to the fixed-length segment in the take-up compartment is withdrawn, the rotation of the reel causes the cord in the take-up compartment to rewind on the take-up hub in the opposite direction to the initial spiral winding. When the fixed-length of cord in the take-up compartment is fully rewound in a tight spiral around the take-up hub, no more cord can be withdrawn from the reel. The locking mechanism, if present, keeps the cord from retracting back into the reel when the pulling force is abated. The biasing spring automatically retracts the cord back onto the reel when the locking mechanism is disengaged.

In some embodiments, the cord reel assembly comprises: (a) a reel rotatably supported within a housing for rotation about an axis; (b) a biasing spring engaged with the reel; and (c) an electrically conductive cord having a distal end portion affixed to the housing, a movable proximal end, and a diameter. The cord is wound about the reel in a plurality of contiguous segments. The housing comprises a first planar member perpendicular to the axis of rotation of the reel, a second planar member spaced from and parallel to the first planar member, and a peripheral wall connecting the first and second planar members substantially surrounding the reel. The peripheral wall defines an opening through which the proximal end of the cord extends.

The reel comprises a cord take-up portion adjacent the first planar member of the housing and a cord storage portion coaxial with and axially spaced from the cord take-up portion in the direction of the second planar member of the housing. The cord take-up portion of the reel comprises a central take-up hub and an annular cord take-up platform connected to and surrounding the take-up hub. The cord take-up platform is spaced from the first planar member of the housing to define an annular cord-take-up compartment between the first planar member and the take-up platform. The spacing between the first planar member of the housing and the take-up platform is greater than one cord diameter in a region immediately adjacent the take-up hub and at least one cord diameter near the peripheral wall of the housing.

The cord storage reel portion comprises a cord storage hub that is coaxial with the cord take-up hub. One axial end of the cord storage hub is connected to the cord-take-up platform and the other axial end of the cord storage hub is connected to a cord storage platform that is spaced from the cord take-up platform, such that the cord take-up hub, the cord take-up platform, the cord storage hub and the cord storage platform rotate together about the same axis of rotation. The spacing between the cord storage platform and the take-up platform defines a cord storage compartment.

A fixed-length segment of the cord is disposed in a spiral winding between the distal end portion of the cord and a transitional segment of the cord that extends through a passageway within the take-up hub and the storage hub. A movable segment of the cord extends from the transitional segment to the proximal end of the cord. The movable segment of cord is at least twice as long as the fixed-length segment of cord in the take-up compartment. In an initial cord storage configuration, the moveable segment of cord is disposed in a plurality of helical windings around the cord storage hub in the same winding direction as the spiral winding of the fixed-length segment of cord in the take-up compartment.

In use, when a pulling force is applied to the proximal end of the cord, the reel rotates thereby unwinding the moveable segment of cord from the cord storage hub and withdrawing the movable segment out of the cord storage compartment. The biasing spring exerts a rotational biasing force opposed to the pulling force. The rotation of the reel causes the spiral of the fixed-length segment of cord in the take-up compartment to begin unwinding, thereby expanding the spiral toward the peripheral wall of the housing. As a portion of the moveable segment of cord longer than the fixed-length segment is withdrawn from the cord storage compartment, the continued rotation of the reel causes the fixed-length segment of cord in the take-up compartment to rewind around the take-up hub in the opposite direction to the helical windings in the cord storage compartment. When a portion of the moveable segment of cord about twice as long as the fixed-length segment has been withdrawn from the cord storage compartment, no more cord can be unwound from the cord storage hub. When the pulling force is abated, the biasing spring urges the reel to rotate in the opposite direction to the rotation caused by the pulling force. This results in the retraction of the moveable segment of cord back onto the cord storage hub in a reversal of the unwinding action caused by the pulling force. The spiral unwinding and rewinding actions in the take-up compartment are also reversed, so that when the entire second length of cord is rewound onto the cord storage hub, the reel assembly is back in the initial cord storage configuration. The spacing between the first planar section of the housing and the take-up platform allows the unwinding spiral to flex upward in the region near the take-up hub during unwinding of the spiral, thus allowing a longer fixed-length segment of cord to be used in the take-up compartment relative to the diameter of the reel compared to prior art reel assemblies in which the take-up compartment is uniformly only about one cord diameter is depth, which inhibits cord flexing. The cord flexing accommodated by the larger depth of the cord take-up compartment of the cord reel assemblies described herein, combined with the use of a single unitary cord, advantageously allows greater miniaturization of the cord reel assembly so that the cord assembly can be used in modern electronic device applications. Another significant advantage of the reel assemblies described herein is that cords meeting modern data and power standard such as USB 2.0 or 3.0, can be used without significant signal and power losses due to, e.g., cord splices, that are problematic for cord reel assemblies using an FFC as part of the reel design.

In some embodiments, the cord take-up platform is bowl-shaped with a peripheral rim and a depressed region adjacent the take-up hub. The rim is spaced at least one cord diameter from the first planar member of the housing. The depressed region is spaced at least about two cord diameters from the first planar section of the housing.

The cord reel assemblies described herein also can include a releasable locking mechanism to arrest rewinding of the reel in a selectable manner.

BRIEF DESCRIPTION OFTHE DRAWINGS

DETAILED DESCRIPTION OF SELECTED EMBODIMENTS

Figure 1:
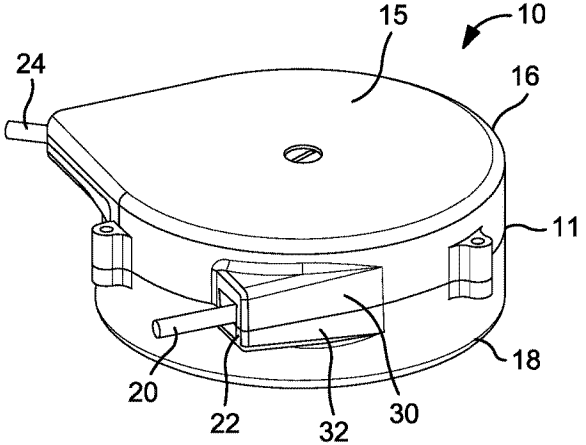
FIG. 1 shows a perspective view of a cord reel assembly 10.
Figure 2:
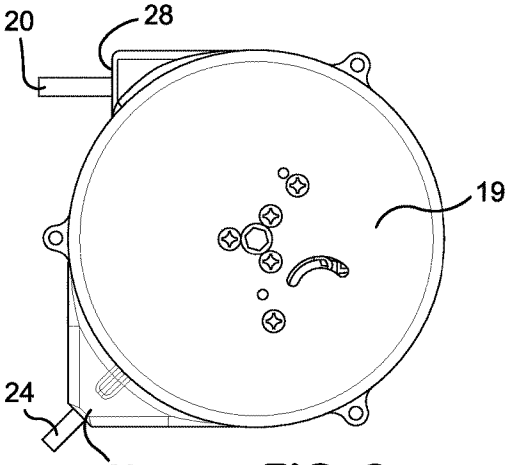
FIG. 2 shows a top plan view of cord reel assembly 10.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

Figure 3:
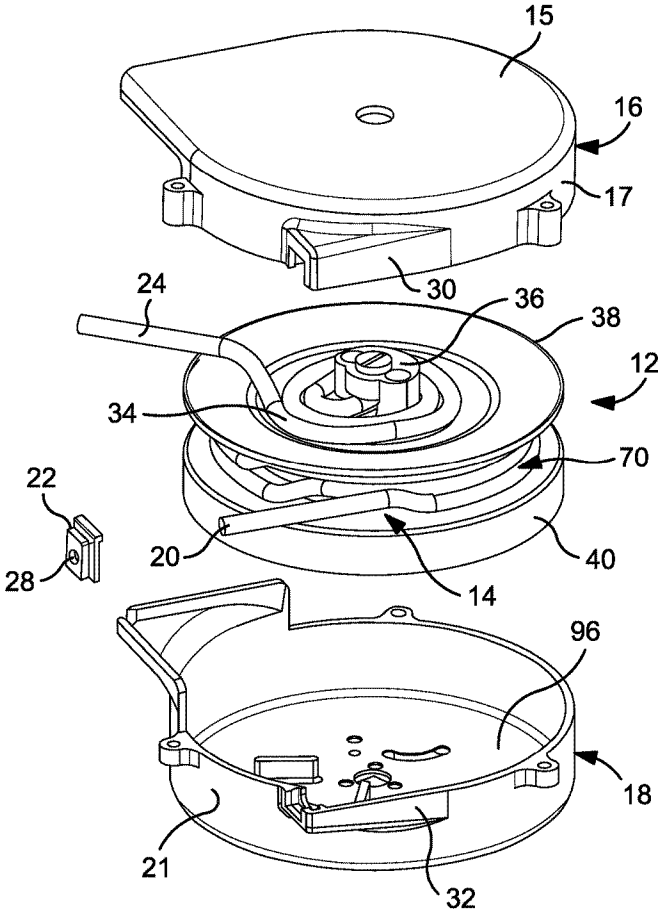
FIG. 3 shows a partially exploded perspective view of cord reel assembly 10.

Referring now to FIGS. 1 through 4, 11, 12, 18, 21 and 22, the cord reel assembly and generally indicated by reference numeral 10 has a generally cylindrically shaped stationary two-part frame or housing assembly 11. As best shown in FIGS. 1 and 3, the housing assembly includes an upper housing member 16 mated with a complementary-shaped lower housing member 18, between which a two-part cord reel 12 is rotatably mounted. Housing member 16 includes a planar member 15 and a side wall 17 partially surrounding planar member 16. Housing member 18 includes planar member 19 and a side-wall 21 at least partially surrounding planar member 19. Sidewalls 17 and 21 have complementary shapes so that when joined together members 16 and 18 form housing assembly 11 substantially surrounding reel 12. Cord reel 12 comprises a take-up reel portion 38 fixedly attached to cord storage reel portion 40, such that the take-up reel and storage reel rotate together about the same axis. A unitary (one piece) electrically conductive cord 14 is wound about reel 12, with a extractable proximal end portion 20 protruding through cord guide 22 of housing assembly 11 and a fixed distal end portion 24 extending through aperture 26 of housing assembly 11. Cord guide 22 is mounted in housing assembly 11 at the terminus of a cord port 28 projecting tangentially from housing assembly 11. Cord port 28 is defined in cord guide 22, which is mounted between tangential extension 30 of upper housing member 16 and complementary tangential extension 32 of lower housing member 18. A fixed-length segment 34 of cord 14 is spirally wound around take-up hub 36 of cord take-up member 38, with the portion of cord at the center of the spiral winding passed through hub 36 and onto cord storage member 40. An extractable distal segment of cord 14 is wound about cord storage hub 42 in overlapping helical windings 70 that are wound about hub 42 in the same direction as the spiral winding of fixed-length segment 34 around hub 36 in the initial cord storage configuration of reel assembly 10.

Figure 19A:
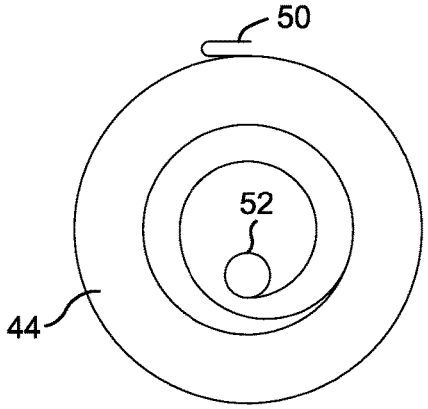
FIG. 19A shows details of the spiral biasing spring of the reel in a top plan view.
Figure 19B:
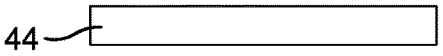
FIG. 19B shows details of the spiral biasing spring of the reel in a side elevation view.
Figure 19C:
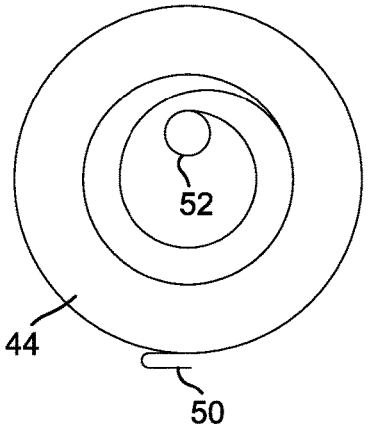
FIG. 19C shows details of the spiral biasing spring of the reel in a bottom plan view.
Figure 20A:
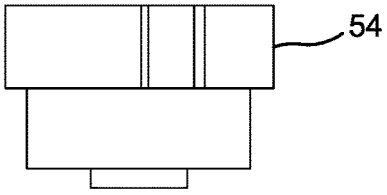
FIG. 20A shows details of the locking hub of the reel in a side elevation view.
Figure 20B:
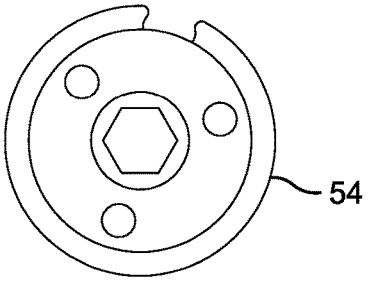
FIG. 20B shows details of the locking hub of the reel in a bottom plan view.
Figure 20C:
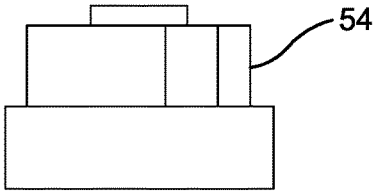
FIG. 20C shows details of the locking hub of the reel in a side elevation view.

Referring to FIGS. 4, 11, 12, 21 and 22, take-up reel portion 38 of reel 12 defines a bowl-shaped upper surface 60 framed by a sloped rim 62. A spiral winding 64 of fixed-length 34 of cord 14 rests within upper surface 60 of take-up reel 38 with distal end portion 24 of cord 14 running along rim 62 and out of cord port 28 where distal portion 24 is fixed in place, e.g., by an adhesive, a knot, compression or any other convenient means. A transitional segment 66 of cord 14 is disposed within passageway 68 defined within take-up hub 36 of take-up reel 38 and the interior 58 of storage hub 42. The cord then passes onto storage reel 40 through passage 56 in cord storage hub 42 and is wound in helical windings 70 around hub 42 in the same winding direction as the spiral winding 64 of the fixed-length 34. A spiral biasing spring 44 is mounted in a receiving channel 72 below storage reel 40 between two shims 46 and 48 with an outer end 50 of biasing spring 44 attached to storage reel 40. Lower hub 74 protrudes into channel 72 and is coaxial with hubs 36 and 42. Lower hub 74 is received within bore 76 of locking hub 54, such that reel 12 can rotate relative to locking hub 54. An inner end 52 of spring 44 is attached to locking hub 54, which is affixed to lower housing member 18 by screw 78 and is coaxial with hubs 36 and 42, such that as reel 12 rotates, biasing spring 44 exerts a counter-rotational force on reel 12. Additional details of biasing spring 44 and locking hub 54 are shown in FIGS. 19 and 20, respectively.

Figure 13:
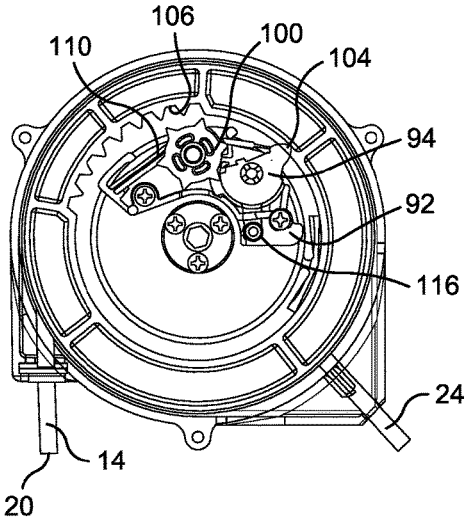
FIG. 13 shows a plan view illustrating details of how locking mechanism 90 is positioned and arranged in the reel assembly.
Figure 14A:
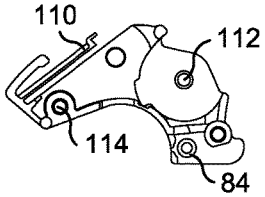
FIG. 14A shows details of the base plate of the locking mechanism in a top plan view.
Figure 14B:
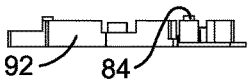
FIG. 14B shows details of the base plate of the locking mechanism in a side elevation view.
Figure 14C:
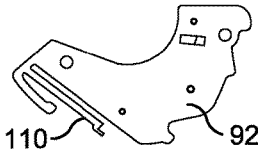
FIG. 14C shows details of the base plate of the locking mechanism in a bottom plan view.
Figure 15A:
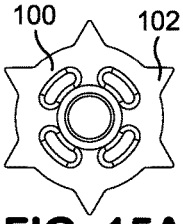
FIG. 15A shows details of the ratchet gear of the locking mechanism in a top plan view.
Figure 16A:
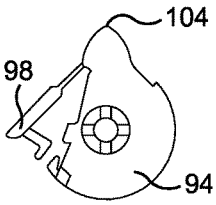
FIG. 16A shows details of the rotation sensor of the locking mechanism in a top plan view.
Figure 15B:
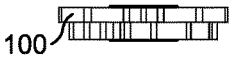
FIG. 15B shows details of the ratchet gear of the locking mechanism in a side elevation view.
Figure 16B:
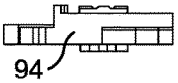
FIG. 16B shows details of the rotation sensor of the locking mechanism in a side elevation view.
Figure 15C:
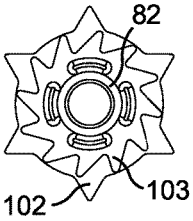
FIG. 15C shows details of the ratchet gear of the locking mechanism in a bottom plan view.
Figure 16C:
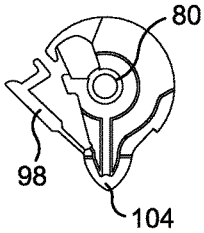
FIG. 16C shows details of the rotation sensor of the locking mechanism in a bottom plan view.
Figure 17A:
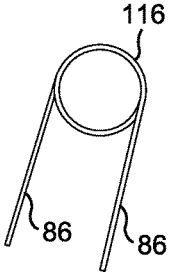
FIG. 17A shows details of the biasing spring of the rotation sensor of the locking mechanism in a top plan view.
Figure 18A:
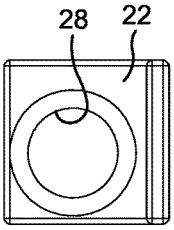
FIG. 18A shows details of the cord guide port of the housing in a top plan view.
Figure 17B:
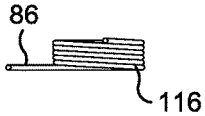
FIG. 17B shows details of the biasing spring of the rotation sensor of the locking mechanism in a side elevation view.
Figure 18B:
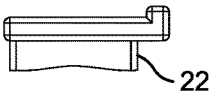
FIG. 18B shows details of the cord guide port of the housing in a side elevation view.
Figure 17C:
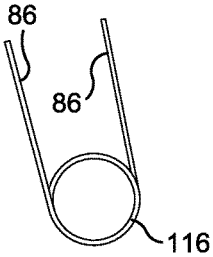
FIG. 17C shows details of the biasing spring of the rotation sensor of the locking mechanism in a bottom plan view.
Figure 18C:
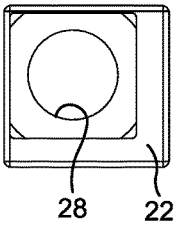
FIG. 18C shows details of the cord guide port of the housing in a bottom plan view.
Figure 22:
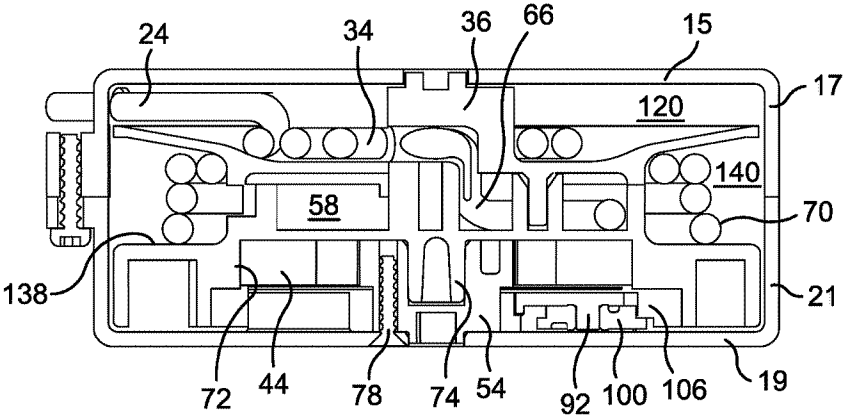
FIG. 22 shows a cross-sectional side elevational view of the reel assembly 10.
Figure 21:
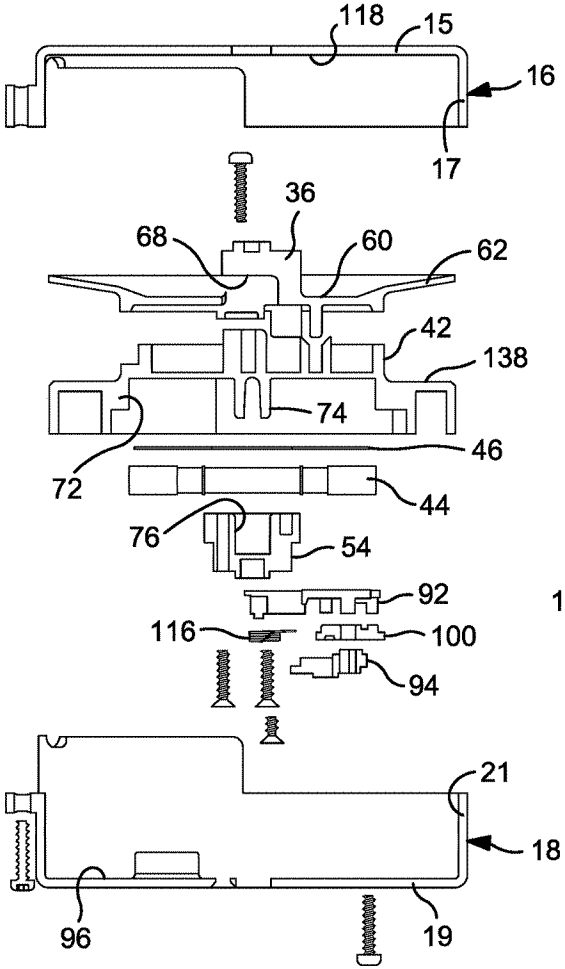
FIG. 21 shows an exploded cross-sectional side elevational view of reel assembly 10.

A locking mechanism 90 comprises base plate 92 mounted to lower housing member 18. As best shown in FIGS. 13, 21, and 22, hub 80 of rotation sensor 94 is pivotally mounted on mounting pin 112 of base plate 92 between base plate 92 and interior bottom surface 96 of lower housing member 18. Hub 86 of ratchet gear 100 is rotationally mounted on mounting pin 114 of base plate 92 between base plate 92 and interior bottom surface 96 of lower housing member 18.

Ratchet gear 100 includes twelve bottom teeth 103 and a six top gear teeth 102. The top teeth 102 are disposed in substantially uniform spaced relation to each other around the wheel, as are the bottom teeth 103. The bottom teeth 103 are arranged such that the base of a bottom tooth 103 is aligned with the base of a top tooth 102 and such that the base of a bottom tooth 103 is disposed substantially in the center between each pair of adjacent top teeth 102. The bottom teeth 103 preferably are shaped in triangles that include one side having an acute angle and another side having an obtuse angle with respect to the base. The top teeth 102 preferably are shaped in generally isosceles triangles. When twelve bottom teeth and six top teeth are used, the arc defined by each pair of adjacent bottom teeth 103 is approximately 30 degrees, and the arc defined by each pair of adjacent top teeth 102 is approximately 60 degrees.

Lever arm 98 of sensor 94 engages with top gear teeth 102 on ratchet gear 100. Back-rotation arresting arm 110 of base plate 92 is positioned to engage with lower teeth 103 of ratchet gear 100, to allow rotation of gear 100 in only one direction. Sensor spring 116 is mounted on pin 84 of base plate 92 adjacent sensor 94 and is arranged and adapted so that one of arms 86 of spring 116 contacts sensor 94 to bias sensor tip 104 to point in the direction radially outward from the axis of rotation of reel 12. The locking mechanism 90 is positioned so that sensor tip 104 can engage with internal gear teeth 106 surrounding a portion of spring receiving chamber 72 underneath storage reel 40, and thereby sense rotation of reel 12. As sensor tip 104 is engaged with internal gear teeth 106 of storage reel 40, lever arm 98 engages with teeth 102 of ratchet gear 100 and base lever arm 93 engages with recessed teeth 103 of gear 100, thereby arresting back rotation of the reel 12 while the internal gear teeth 106 are engaged with sensor tip 104. Sensor spring 116 insures that the sensor tip 104 will move into engagement with the internal gear teeth 106 when rotation of reel 12 brings teeth 106 into alignment with sensor 94 by biasing the tip 104 toward the periphery of chamber storage hub 40.

When reel 12 is rotated by withdrawing a portion of cord 14 from storage reel 40, biasing spring 44 is compressed by tightening of the spiral winding thereof. When the pulling force on the withdrawn cord 14 is released, the spring causes reel 12 to rotate back in the opposite direction. When the reel has rotated back sufficiently such that tip 104 can engage with internal gear 106, the locking mechanism can halt the back rotation. Additional details of the components of locking mechanism 90 are shown in FIGS. 14, 15, 16, and 17. The locking mechanism described herein operates in substantially the same way as locking mechanism described, e.g., in U.S. Pat. No. 6,293,485 to Hollowed, which is incorporated herein by reference in its entirety.

Figure 4:
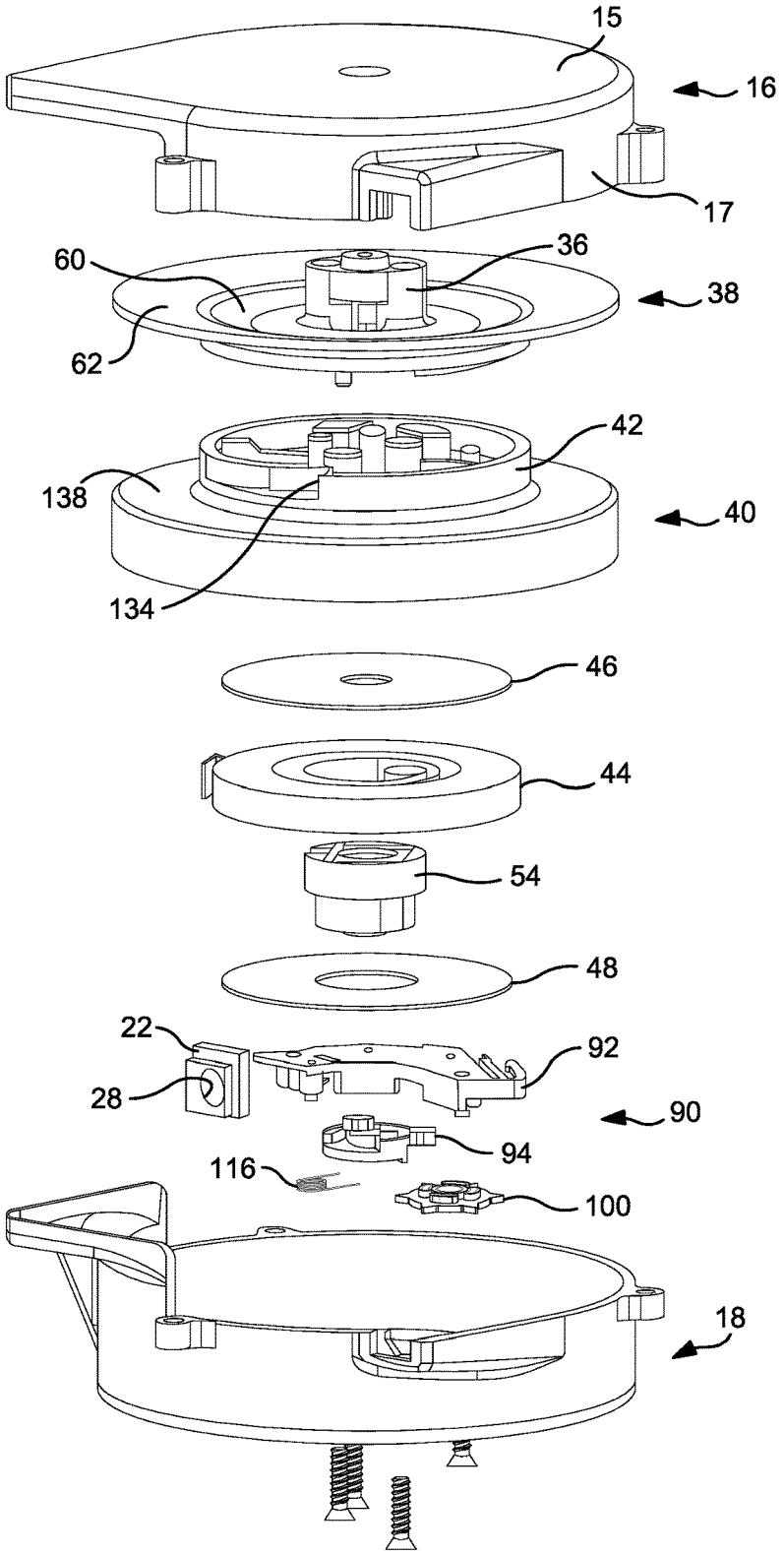
FIG. 4 shows a perspective exploded view of cord reel assembly 10.
Figure 5A:
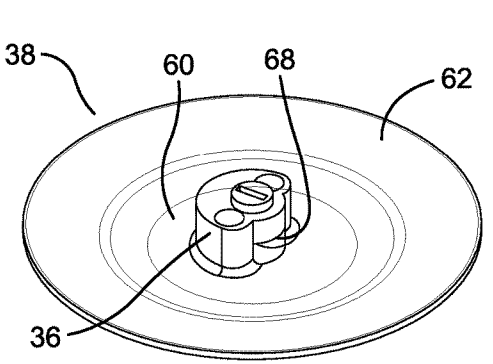
FIG. 5A shows an exploded perspective view of a cord reel illustrating the take-up portion of the reel.
Figure 5B:
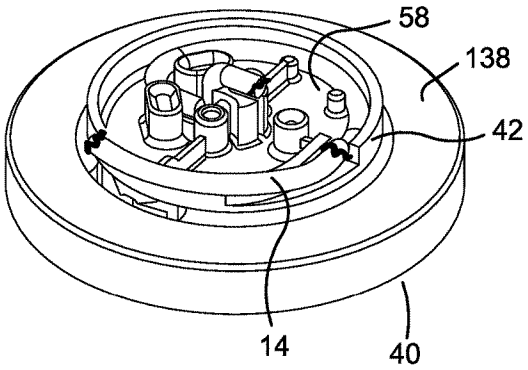
FIG. 5B shows an exploded perspective view of a cord reel illustrating the cord storage portion of the reel.
Figure 6A:
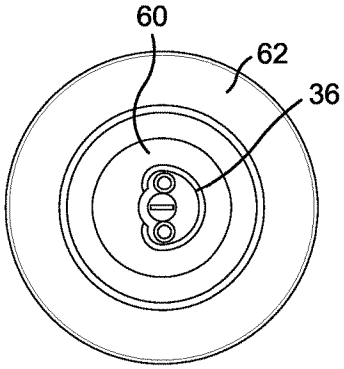
FIG. 6A shows a top plan view of the cord take-up portion of the reel.
Figure 6B:
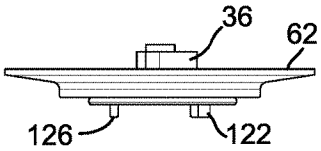
FIG. 6B shows a side elevation view of the cord take-up portion of the reel.
Figure 6C:
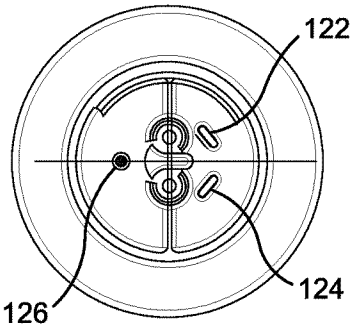
FIG. 6C shows a bottom plan view of the cord take-up portion of the reel.
Figure 7A:
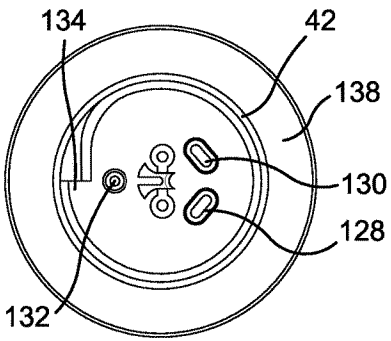
FIG. 7A shows a top plan view of the cord storage portion of the reel.
Figure 7B:
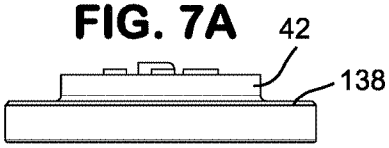
FIG. 7B shows a side elevation view of the cord storage portion of the reel.
Figure 7C:
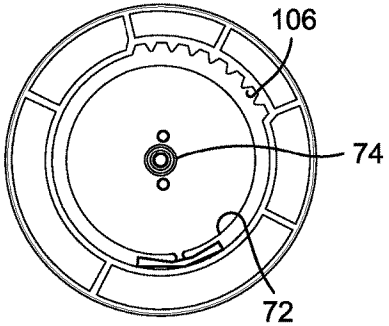
FIG. 7C shows a bottom plan view of the cord storage portion of the reel.
Figure 11A:
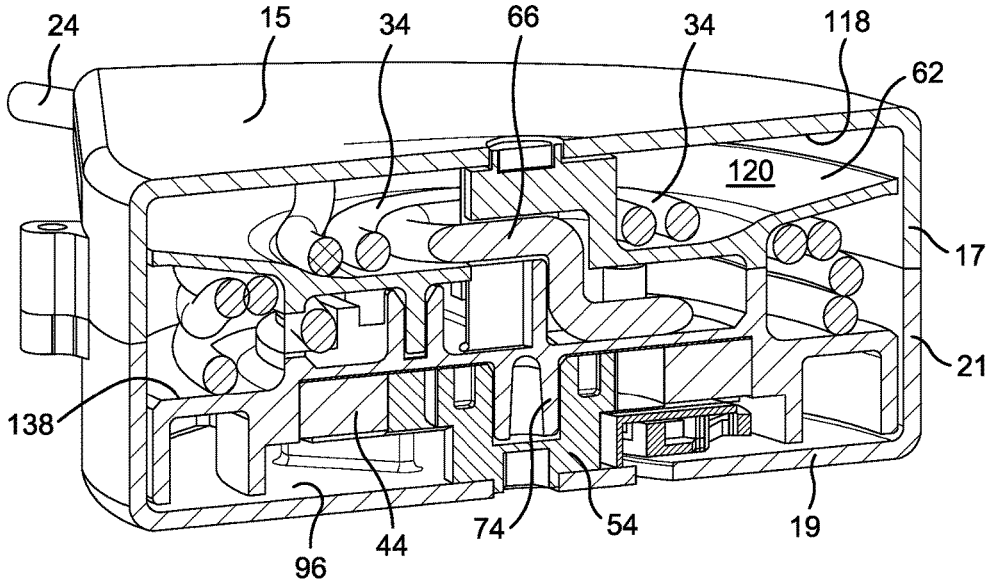
FIG. 11A shows a cross-sectional view along line XSEC0006-XSEC0006 in FIG. 8, in a perspective view.
Figure 11B:
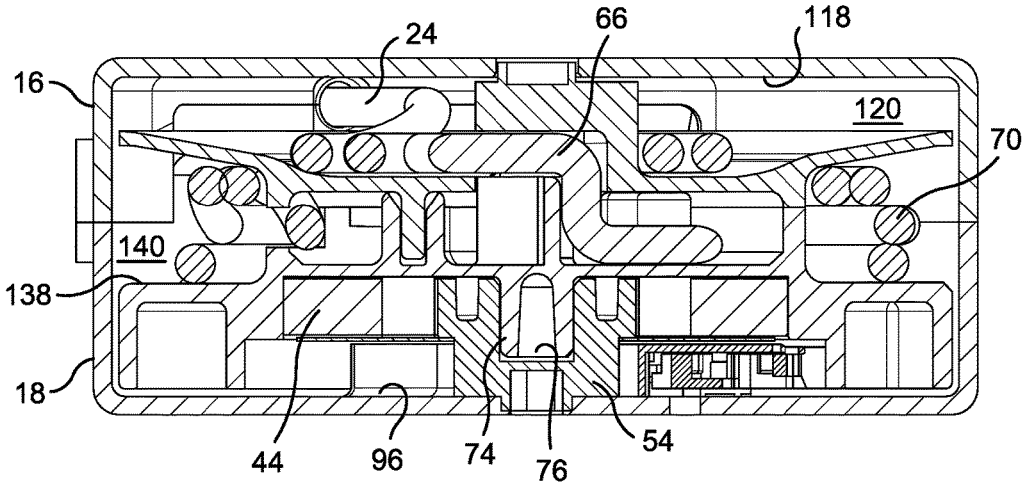
FIG. 11B shows a cross-sectional view along line XSEC0006-XSEC0006 in FIG. 8, in a side elevational view.
Figure 12A:
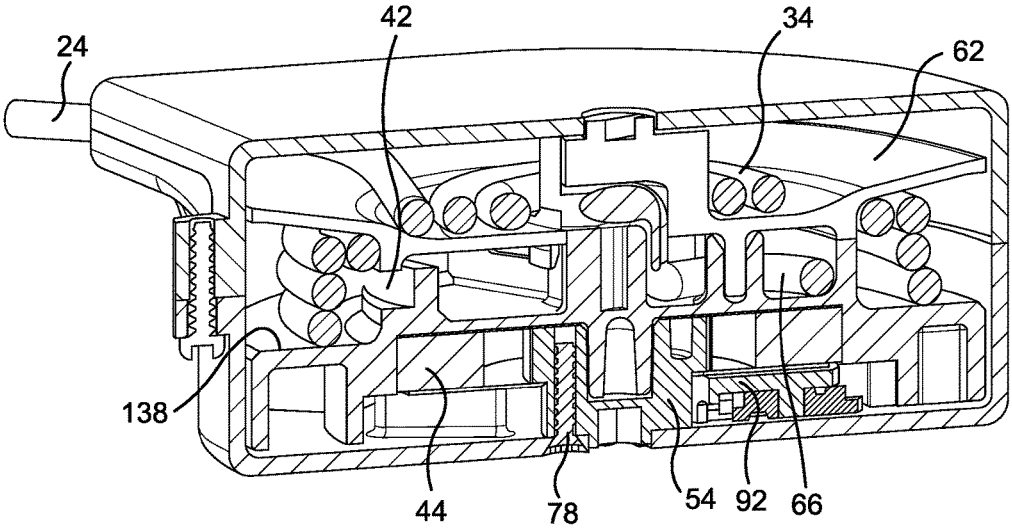
FIG. 12A shows a cross-sectional view along line XSEC0002-XSEC0002 in FIG. 8, in a perspective view.
Figure 12B:
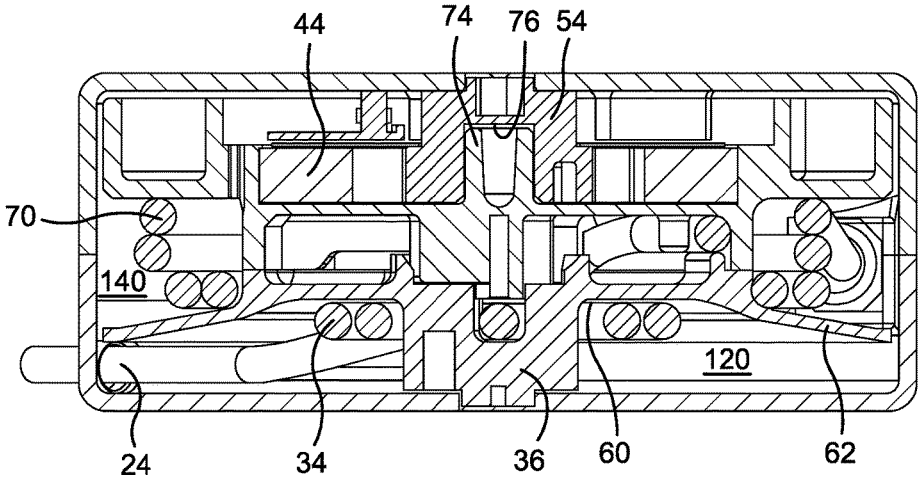
FIG. 12B shows a cross-sectional view along line XSEC0002-XSEC0002 in FIG. 8, in a side elevational view.

As shown best in FIGS. 11, 12, and 22, reel 12 is rotationally mounted between housing members 16 and 18 such that the internally geared side of storage reel 40 faces inner bottom surface 96 of housing member 18 and the bowl-shaped upper surface 60 of take-up reel 38 faces inner upper surface 118 of upper housing member 16, and is spaced therefrom. The space around take-up hub 36 between bowl-shaped upper surface 60 and inner surface 118 defines an annular cord take-up compartment 120 in which the fixed-length segment 34 of cord 14 is coiled. As best seen in FIGS. 4, 6, and 7, take-up reel 38 includes mounting tabs 122 and 124 and mounting pin 126 and the interior of storage hub 42 includes receiving slots 128 and 130 and receiving collar 132. Tabs 122 and 124 are arranged to be received within slots 128 and 130, while pin 126 is received within collar 132 to keep take-up reel 38 rotationally locked with storage reel 40. An annular platform surface 138 of storage hub 40 faces rim 62 of take-up reel 38 and is spaced therefrom. The gap between rim 62 and platform surface 138 around hub 42 defines a cord storage compartment 140 in which the helical windings 70 of cord 14 are stored. Passageway 68 of take-up reel 38 opens into the interior 58 of storage hub 42, while hub 42 includes a passage 134 to allow cord 14 to pass from the interior 58 of hub 42 into annular cord storage compartment 140 where the cord is helically wind around hub 42.

The fixed-length of cord 34 wound within the take-up compartment is approximately half the length of the maximum length of cord that is intended to be withdrawn from the reel during use of the cord reel assembly. The helically wound portion 70 of cord 14 within the cord storage compartment 140 when reel 12 is in an initial cord storage configuration (FIG. 8) is longer than the maximum length of cord that can be withdrawn from the cord storage compartment 140 during use. The cord wound around hub 42 of the cord storage compartment 140 has an inner winding connected to the first or inner winding on the cord take-up hub 42 via a transitional segment 66 of cord 14 disposed within hub 36 and interior 58 of hub 42. The fixed potion 34 of cord 14 in the cord take-up compartment 120 is wound in a relatively tight one-dimensional spiral around the take-up hub 36 in the initial cord storage configuration of the reel assembly, while the portion of cord in the cord storage hub is wound in overlapping layers of helical windings 70 thereabout with the proximal end of the cord extending out of reel assembly 10 through cord guide 22.

Figure 9:
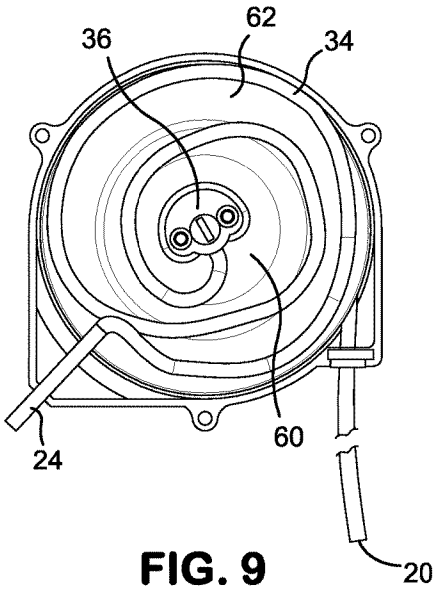
FIG. 9 illustrates the expansion and unwinding of the spiral winding of the fixed-length segment of cord on the cord storage platform after the reel has been rotated in response to pulling on the proximal end of the cord.
Figure 10:
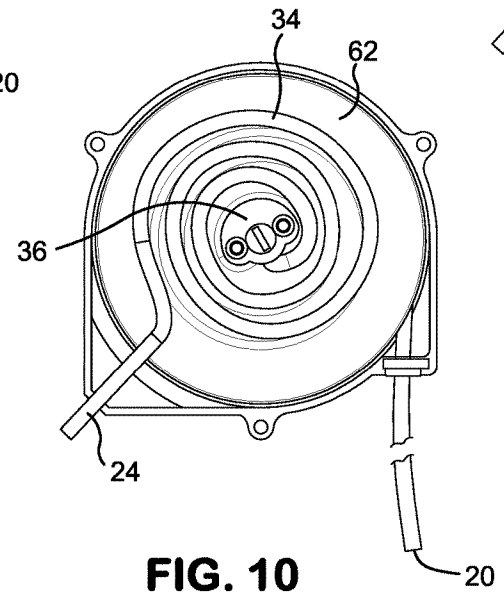
FIG. 10 illustrates the reversed spiral winding of the fixed-length segment of cord on the cord storage platform after a length of cord longer than the fixed length has been extracted from the cord storage reel.
Figure 8:
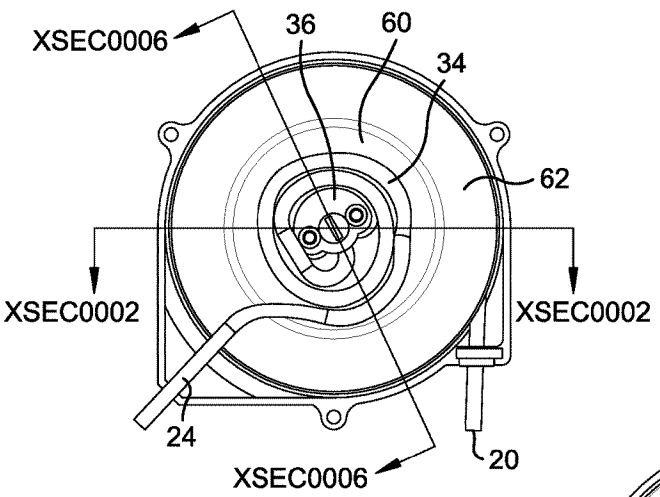
FIG. 8 illustrates the spiral winding of the fixed-length segment of cord on the cord storage platform around the cord storage hub in the initial cord storage configuration of the cord reel assembly.

In use, the housing 11 of the reel assembly 10 is generally affixed to a surface or otherwise held stationary and a pulling force greater than the biasing force of the biasing spring 44 is applied to the proximal end 20 of the cord 14, causing reel 12 to rotate relative to the housing 11, and causes a portion of the cord 14 in the cord storage compartment to unwind and withdraw from reel assembly 10. Simultaneously, the rotation of reel 12 causes the spiral winding of fixed-length segment 34 of cord 14 in the take-up compartment 120 to loosen and expand radially toward the periphery of the take-up compartment 120 (FIG. 9). The gap between the storage platform 138 of storage reel 40 and the rim 62 of take-up reel 38 allows at least the windings nearest the take-up hub 36 to flex slightly in the direction along the rotational axis toward rim 62, which surprisingly allows for a smaller reel size while ameliorating binding of the fixed-length of cord as the spiral windings loosen, compared to prior art reels that include a take-up chamber that is sized to prevent flexing of the cord Once a length of cord 14 approximately equal to the fixed-length segment 34 is withdrawn from storage compartment 140, the continued rotation of reel 12 causes the fixed-length segment 34 in the take-up compartment 120 to rewind on the take-up hub 36 in the opposite direction to the spiral winding thereof in the initial cord storage configuration (FIG. 10). When the fixed-length segment 34 of cord in the take-up compartment 120 is fully rewound in a tight spiral around the take-up hub 36, no more cord 14 can be withdrawn from the reel 12 (FIG. 8).

The locking mechanism 90 keeps the withdrawn cord 14 from retracting back into cord storage compartment 140 when the pulling force on cord 14 is abated or removed. When locking mechanism 90 is disengaged, biasing spring 44 automatically causes cord 14 to withdraw back into cord storage compartment 140 to helically wind around hub 42. If he length of cord withdrawn from storage compartment 140 is longer than fixed-length segment 34, the spiral winding of fixed-length segment 34 of cord 14 in cord take-up compartment 120 loosens and unwinds until a length of cord 14 about equal to fixed-length segment 34 is wound around hub 42, at which point continued rotation of reel 12 to rewind around more of cord 14 into storage compartment 140 causes the fixed-length segment 34 to rewind in the same direction as the helical windings 70 until the entire withdrawn portion of cord 14 is rewound on hub 42. At this point, reel assembly 10 is back in the initial cord storage configuration.

All the parts of the reel assembly, except for example, the screws, are preferably made of a suitable molded synthetic plastic material, although they could be made of metal. It is apparent that the present invention provides an exceedingly compact and economical cord reel construction. It should be understood that numerous modifications may be made in the most preferred form of the invention described without deviating from the broader aspects of the invention.

LISTING OF REFERENCE NUMBERS AND PARTS

Ref # Description of Part

10 cord reel assembly
11 housing assembly
12 two-part cord reel
14 electrically conductive cord
16 upper housing member
18 lower housing member
20 proximal end of cord
22 cord guide
24 distal end portion of cord
26 aperture in housing
28 cord port in housing
30 tangential extension of upper housing member
32 tangential extension of lower housing member
34 fixed-length segment of cord
36 take-up hub
38 cord take-up member
40 cord storage member
42 cord storage hub 44
44 biasing spring
46 shim
48 shim
50 outer end of biasing spring
52 inner end of biasing spring
54 locking hub
56 passage in cord storage hub
58 interior of cord storage hub
60 bowl-shaped upper surface of cord take-up member
62 rim of cord take-up member
66 transitional segment of cord
68 passageway within take-up hub
70 helical windings of cord
72 spring receiving channel
74 lower hub of cord storage reel
76 internal bore of locking hub
80 hub of rotation sensor
82 hub of ratchet gear
84 mounting pin for sensor biasing spring
86 arms of sensor biasing spring
90 locking mechanism
92 base plate of locking mechanism
94 rotation sensor of locking mechanism
96 interior bottom surface of lower housing member
98 lever arm of rotation sensor
100 ratchet gear of locking mechanism
102 top teeth of ratchet gear
103 bottom teeth of ratchet gear
104 sensor tip
106 internal gear teeth of spring receiving channel
110 back rotation arresting arm of base plate
112 sensor mounting pin of base plate
114 gear mounting pin of base plate
116 rotation sensor spring
118 interior upper surface of upper housing member
120 annular cord take-up compartment
122 mounting tap of take-up reel
124 mounting tap of take-up reel
126 mounting pin of take-up reel
128 tab receiving slot of cord storage hub
130 tab receiving slot of cord storage hub
132 tab receiving collar of cord storage hub
134 passage in cord storage hub
138 annular platform surface of storage reel
140 annular cord storage compartment All references, including publications, patent applications and patents, cited herein are hereby incorporated by reference to the same extent as if each reference were individually and specifically indicated to be incorporated by reference and were set forth in its entirety herein. the terms "cord" and "cable" are used herein interchangeably to refer to insulated electrically conductive wires, cords, cables and the like, and are to be given their common meaning in the electric and electronic arts. The use of the terms "a" and "an" and "the" and similar referents in the context of describing the present invention (especially in the context of the following claims) are to be construed to cover both the singular and the plural, unless otherwise indicated herein or clearly contradicted by context. The use of terms "including", "having" and "comprising" and like terms are to be construed as open ended terms, meaning including, but not limited to, unless otherwise indicated, or clearly contradicted by context, herein. The use of any and all examples, or exemplary language (e.g., "such as") provided herein is intended merely to better illuminate the present invention and does not pose a limitation on the scope of the claimed invention. No language in the specification should be construed as indicating any non-claimed element as essential to the practice of the invention.

The foregoing is an integrated description of the invention as a whole, not merely of any particular element or facet thereof. The description describes "preferred embodiments" of this invention, including the best mode known to the inventors for carrying it out. Of course, upon reading the foregoing description, variations of those preferred embodiments will become obvious to those of ordinary skill in the art. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is possible unless otherwise indicated herein or otherwise clearly contradicted by context.

What is claimed is:

1. A cord reel assembly comprising:

(a) a reel rotatably supported by a frame for rotation about an axis;

(b) a biasing spring engaged with the reel;

(c) an electrically conductive cord having a distal end portion affixed to the frame, and wound about the reel in a plurality of contiguous segments, a movable proximal end, and a diameter;

wherein:

the frame comprises a first planar member perpendicular to the axis of rotation of the reel, a second planar member spaced from and parallel to the first planar member, the first and second planar members arranged in a fixed relation to each other;

the reel comprises a cord take-up portion adjacent the first planar member of the frame and a cord storage portion coaxial with the take-up portion and axially spaced therefrom in the direction of the second planar member of the frame;

the cord take-up portion of the reel comprises a central take-up hub and an annular cord take-up platform connected to and surrounding the take-up hub, and the cord take-up platform is spaced from the first planar member of the frame to define an annular cord-take-up compartment between the first planar member and the take-up platform, wherein a spacing between the first planar member of the frame and the take-up platform is greater than one cord diameter in a region immediately adjacent the take-up hub and at least one cord diameter near the peripheral region of the cord-take-up portion of the reel;

the cord storage portion comprises a cord storage hub that is coaxial with the cord take-up hub, one axial end of the cord storage hub is connected to the cord-take-up platform and the other axial end of the cord storage hub is connected to a cord storage platform that is spaced from the cord take-up platform, such that the cord take-up hub, the cord take-up platform, the cord storage hub and the cord storage platform rotate together about the same axis of rotation; and the spacing between the cord storage platform and the take-up platform defines a cord storage compartment;

a fixed-length segment of the cord is disposed in a spiral winding between the distal end portion of the cord and a transitional segment of the cord that extends through a passageway within the take-up hub and the storage hub; a movable segment of the cord extends from the transitional segment to the proximal end of the cord; and the movable segment of cord is at least twice as long as the fixed-length segment of cord in the take-up compartment;

in an initial storage configuration, the moveable segment of cord is disposed in a plurality of helical windings around the cord storage hub in the same winding direction as the spiral winding of the fixed-length segment of cord in the take-up compartment;

in use, when a pulling force is applied to the proximal end of the cord, the reel rotates thereby unwinding the moveable segment of cord from the cord storage hub and withdrawing the movable segment out of the cord storage compartment; the biasing spring exerts a rotational biasing force opposed to the pulling force; the rotation of the reel causes the spiral of the fixed-length segment of cord in the take-up compartment to begin unwinding, thereby expanding the spiral toward the periphery of the cord take-up platform as a portion of the moveable segment of cord longer than the fixed-length segment is withdrawn from the cord storage compartment, the continued rotation of the reel causes the fixed-length segment of cord in the take-up compartment to rewind around the take-up hub in the opposite direction to the helical windings in the cord storage compartment, and when a portion of the moveable segment of cord about twice as long as the fixed-length segment has been withdrawn from the cord storage compartment, no more cord can be unwound from the cord storage hub; and when the pulling force is abated, the biasing spring urges the reel to rotate in the opposite direction to the rotation caused by the pulling force, thus retracting the moveable segment of cord back onto the cord storage hub in a reversal of the unwinding action caused by the pulling force, and thereby also reversing the spiral unwinding and rewinding actions in the take-up compartment, so that when the entire second length of cord is rewound onto the cord storage hub, the reel assembly is back in the initial cord storage configuration.

2. The cord reel assembly of claim 1, wherein the cord take-up platform is bowl-shaped with a peripheral rim and a depressed region adjacent the take-up hub.

3. The cord reel assembly of claim 2, wherein the rim of the cord take-up platform is spaced at least one cord diameter from the first planar member of the frame.

4. The cord reel assembly of claim 3, wherein a releasable locking mechanism is engageable with the reel, the locking mechanism being arranged and configured to arrest rewinding of the reel in a selectable manner.

5. The cord reel assembly of claim 2, wherein the depressed region of the cord take-up platform is spaced at least about two cord diameters from the first planar member of the frame.

6. The cord reel assembly of claim 5, wherein a releasable locking mechanism is engageable with the reel, the locking mechanism being arranged and configured to arrest rewinding of the reel in a selectable manner.

7. The cord reel assembly of claim 2, wherein a releasable locking mechanism is engageable with the reel, the locking mechanism being arranged and configured to arrest rewinding of the reel in a selectable manner.

8. The cord reel assembly of claim 1, wherein a releasable locking mechanism is engageable with the reel, the locking mechanism being arranged and configured to arrest rewinding of the reel in a selectable manner.

9. The cord reel assembly of claim 1, wherein a peripheral wall substantially surrounding the reel connects the first and second planar members of the frame; the peripheral wall defining an opening through which the proximal end of the cord extends.

10. A cord reel assembly comprising:

(a) a reel rotatably supported within a housing for rotation about an axis;

(b) a biasing spring engaged with the reel;

(c) an electrically conductive cord having a distal end portion affixed to the housing, and wound about the reel in a plurality of contiguous segments, a movable proximal end, and a diameter;

wherein:

the housing comprises a first planar member perpendicular to the axis of rotation of the reel, a second planar member spaced from and parallel to the first planar member, and a peripheral wall connecting the first and second planar members substantially surrounding the reel; the peripheral wall defining an opening through which the proximal end of the cord extends;

the reel comprises a cord take-up portion adjacent the first planar member of the housing and a cord storage portion coaxial with and axially spaced from the cord take-up portion in the direction of the second planar member of the housing;

the cord take-up portion of the reel comprises a central take-up hub and an annular cord take-up platform connected to and surrounding the take-up hub, and the cord take-up platform is spaced from the first planar member of the housing to define an annular cord-take-up compartment between the first planar member and the take-up platform, wherein a spacing between the first planar member of the housing and the take-up platform is greater than one cord diameter in a region immediately adjacent the take-up hub and at least one cord diameter near the peripheral wall of the housing;

wherein the cord take-up platform is bowl-shaped with a peripheral rim and a depressed region adjacent the take-up hub;

the cord storage reel portion comprises a cord storage hub that is coaxial with the cord take-up hub, one axial end of the cord storage hub is connected to the cord-take-up platform and the other axial end of the cord storage hub is connected to a cord storage platform that is spaced from the cord take-up platform, such that the cord take-up hub, the cord take-up platform, the cord storage hub and the cord storage platform rotate together about the same axis of rotation; and the spacing between the cord storage platform and the take-up platform defines a cord storage compartment;

a fixed-length segment of the cord is disposed in a spiral winding between the distal end portion of the cord and a transitional segment of the cord that extends through a passageway within the take-up hub and the storage hub; a movable segment of the cord extends from the transitional segment to the proximal end of the cord; and the movable segment of cord is at least twice as long as the fixed-length segment of cord in the take-up compartment;

in an initial cord storage configuration, the moveable segment of cord is disposed in a plurality of helical windings around the cord storage hub in the same winding direction as the spiral winding of the fixed-length segment of cord in the take-up compartment;

in use, when a pulling force is applied to the proximal end of the cord, the reel rotates thereby unwinding the moveable segment of cord from the cord storage hub and withdrawing the movable segment out of the cord storage compartment; the biasing spring exerts a rotational biasing force opposed to the pulling force; the rotation of the reel causes the spiral of the fixed-length segment of cord in the take-up compartment to begin unwinding, thereby expanding the spiral toward the peripheral wall of the housing; as a portion of the moveable segment of cord longer than the fixed-length segment is withdrawn from the cord storage compartment, the continued rotation of the reel causes the fixed-length segment of cord in the take-up compartment to rewind around the take-up hub in the opposite direction to the helical windings in the cord storage compartment, and when a portion of the moveable segment of cord about twice as long as the fixed-length segment has been withdrawn from the cord storage compartment, no more cord can be unwound from the cord storage hub; and when the pulling force is abated, the biasing spring urges the reel to rotate in the opposite direction to the rotation caused by the pulling force, thus retracting the moveable segment of cord back onto the cord storage hub in a reversal of the unwinding action caused by the pulling force, and thereby also reversing the spiral unwinding and rewinding actions in the take-up compartment, so that when the entire second length of cord is rewound onto the cord storage hub, the reel assembly is back in the initial cord storage configuration.

11. The cord reel assembly of claim 10, wherein the peripheral rim of the cord take-up platform is spaced at least one cord diameter from the first planar member.

12. The cord reel assembly of claim 11, wherein a releasable locking mechanism is engageable with the reel, the locking mechanism being arranged and configured to arrest rewinding of the reel in a selectable manner.

13. The cord reel assembly of claim 10, wherein the depressed region of the cord take-up platform is spaced at least about two cord diameters from the first planar member of the housing.

14. The cord reel assembly of claim 13, wherein a releasable locking mechanism is engageable with the reel, the locking mechanism being arranged and configured to arrest rewinding of the reel in a selectable manner.

15. The cord reel assembly of claim 10, wherein a releasable locking mechanism is engageable with the reel, the locking mechanism being arranged and configured to arrest rewinding of the reel in a selectable manner.

* * * * *